US005498303A

United States Patent [19]

Hinshaw et al.

[11] Patent Number: 5,498,303

[45] Date of Patent: Mar. 12, 1996

[54] PROPELLANT FORMULATIONS BASED ON DINITRAMIDE SALTS AND ENERGETIC BINDERS

[75] Inventors: Carol J. Hinshaw, Ogden; Robert B. Wardle, Logan; Tom K. Highsmith, North Ogden, all of Utah

[73] Assignee: Thiokol Corporation, Ogden, Utah

[21] Appl. No.: 52,035

[22] Filed: Apr. 21, 1993

[51] Int. Cl.[6] ..... C06B 45/10

[52] U.S. Cl. ..... 149/19.6; 149/19.4

[58] Field of Search ..... 149/19.1, 19.4, 149/19.6

[56] References Cited

U.S. PATENT DOCUMENTS

| | | | |
|---|---|---|---|
| 3,609,115 | 9/1971 | Herring | 260/32.4 |
| 3,645,809 | 2/1972 | Stow, Jr. | 149/38 |
| 3,680,483 | 8/1972 | Staudacher et al. | 102/37.8 |
| 3,687,954 | 8/1972 | Tyler, III et al. | 260/268 R |
| 3,811,358 | 5/1974 | Morse | 86/20 R |
| 3,953,258 | 4/1976 | Sayles | 149/19.3 |
| 4,158,583 | 6/1979 | Frosch et al. | 149/19.4 |
| 4,410,376 | 10/1983 | Breunner et al. | 149/19.4 |
| 4,707,540 | 11/1987 | Maaser et al. | 528/417 |
| 4,804,424 | 2/1989 | Hinshaw | 149/19.4 |
| 4,915,755 | 4/1990 | Kim | 149/19.4 |
| 5,076,868 | 12/1991 | Doll et al. | 149/19.4 |
| 5,120,827 | 6/1992 | Willer et al. | 528/408 |
| 5,198,204 | 3/1993 | Bottaro et al. | 423/385 |
| 5,271,778 | 12/1993 | Bradford et al. | 149/19.4 |

*Primary Examiner*—Edward A. Miller

*Attorney, Agent, or Firm*—Ronald L. Lyons; Madson & Metcalf

[57] ABSTRACT

Composite propellant formulations are disclosed having a dinitramide salt oxidizer, such as ammonium dinitramide, an energetic binder, such as poly(glycidyl nitrate), a reactive metal, such as aluminum, and other typical propellant ingredients such as curatives and stabilizers. The disclosed propellant formulations are able to combust aluminum efficiently, possess high burn rates, and produce little or no HCl exhaust gases.

9 Claims, No Drawings

PROPELLANT FORMULATIONS BASED ON DINITRAMIDE SALTS AND ENERGETIC BINDERS

BACKGROUND OF THE INVENTION

1. Field of the Invention

This invention relates to low-hazard solid rocket propellant formulations which use little or no chlorine-containing oxidizers. More specifically, the present invention relates to propellant formulations based on a dinitramide salt oxidizer and an energetic binder.

2. Technology Background

Solid propellants are used extensively in the aerospace industry and are a preferred method of powering most missiles and rockets for military, commercial, and space applications. Solid rocket motor propellants have become widely accepted because they are relatively simple to manufacture and use, and because they have excellent performance characteristics.

Typical solid rocket motor propellants are formulated using an oxidizing agent, a fuel, and a binder. At times, the binder and the fuel may be the same. In addition to the basic components, it is conventional to add various bonding agents, plasticizers, curing agents, cure catalysts, and other similar materials which aid in the processing or curing of the propellant or contribute to mechanical properties improvements of the cured propellant. A significant body of technology has developed related solely to the processing and curing of solid propellants.

Many types of propellants used in the industry use ammonium perchlorate (AP) as the oxidizer. AP has been a preferred oxidizer because of its high energy with relatively low associated hazards, its ability to efficiently oxidize the commonly-used aluminum fuel, and its burn rate tailorability. However, there is some interest in the industry to identify alternative oxidizers having similar attractive properties which do not produce chlorine-containing exhaust products.

A commonly used low-hazard nonchlorine oxidizer is ammonium nitrate (AN). This oxidizer has also been examined in many types of propellants. Unfortunately, AN is well known for its poor performance capability, its inability to combust aluminum efficiently, and its low propellant burn rates. These problems continue to plague nonchlorine propellant development efforts.

Accordingly, it would be a significant advancement in the art to provide propellant formulations of equivalent or improved energy capable combusting aluminum efficiently, providing high propellant burn rates, and producing little or no HCl exhaust emissions.

Such propellant formulations are disclosed and claimed herein.

SUMMARY OF THE INVENTION

The invention is directed to the use of a dinitramide salt as the major oxidizer in combination with an energetic binder in propellant formulations. Such propellants contain no chlorine when the dinitramide salt is the only oxidizer or is used in combination with another nonchlorine oxidizer, or reduced chlorine when the dinitramide salt is used in combination with AP.

The dinitramide salts used according to the present invention have the following general formula: $X^+[N(NO_2)_2]^-$, where $X^+$ is the cationic counterion. Currently preferred counterions are those that complement the energetic properties of the dinitramide anion such as ammonium ion, tetrazole ion, aminotetrazole ion, and diaminofurazan ion. Ammonium dinitramide (ADN) is a currently preferred oxidizer according to the present invention.

The propellant formulations of the present invention preferably include an energetic binder, such as substituted oxetane polymers, nitramine polymers, polyethers, and polycaprolactones (any of which may be either plasticized or unplasticized). Reactive metals, such as aluminum, magnesium, aluminum-magnesium alloys, and boron, are also preferably included in the propellant formulations of the present invention.

It has been found that propellant formulations containing a dinitramide salt, aluminum, and energetic binder possess high burn rates in a range comparable to propellants containing ammonium perchlorate.

DETAILED DESCRIPTION OF THE INVENTION

The present invention is directed to low-hazard solid rocket propellant formulations which do not require use of a chlorine-containing oxidizer. Dinitramide salts are used in combination with energetic binders to produce composite propellant formulations having high burn rates and performance comparable to conventional propellants based on ammonium perchlorate. Importantly, the propellants of the present invention do not produce high levels of chlorine-containing exhaust products. A method of forming dinitramide salts is disclosed in U.S. Pat. No. 5,198,204, granted Mar. 30, 1993, which is incorporated herein by reference.

The dinitramide salts used according to the present invention have the following general formula: $X^+[N(NO_2)_2]^-$, where $X^+$ is the cationic counterion. Currently preferred counterions are those that complement the energetic properties of the dinitramide anion such as ammonium ion ($NH_4^+$), tetrazole ion, having the following structure:

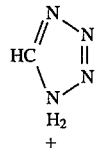

aminotetrazole ion, having the following structure:

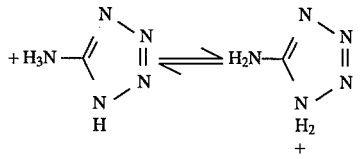

and diaminofurazan ion having the following structure:

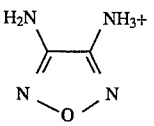

Cations of nitrogen containing heterocycles having the following general structure are preferred.

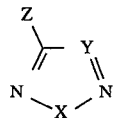

Where X is N, O, or $CH_2$; Y is N, $CNH_2$, CH, or $CNO_2$; and Z is H, $NH_2$, or $NHNO_2$. Cations based on polycyclic polyamines such as bitetrazole, azobitetrazole, bitetrazoleamine, azoaminobitetrazole, analogous triazoles, and the like are also preferred counterions. Other possible cationic counterions which can be used with dinitramide anions include 1–8 nitrogen-containing cations of the formula $(R''_kH_mN_n)^{+z}$, wherein n=1 to 8, k=0 to 2+n, z=1 to n, m=3+n-k, and each R" is the same or different 1–6 carbon straight chain or branched alkyl. Examples of such ions include $NH_4^+$, $CH_3NH_3^+$, $(CH_3)_2NH_2^+$, $(CH_3)_3NH^+$, $(CH_3)_4N^+$, $C_2H_5NH_4^+$, $(C_2H_5)_2NH_2^+$, $(C_2H_5)_3NH^+$, $(C_2H_5)_4N^+$, $(C_2H_5)(CH_3)NH_2^+$, $(C_2H_5)(CH_3)_2NH^+$, $(C_2H_5)_2(CH_3)_2N^+$, $(C_3H_7)_4N^+$, $(C_4H_9)_4N^+$, $N_2H_5^+$, $CH_3N_2H_4^+$, $(CH_3)_2N_2H_3^+$, $(CH_3)_3N_2H_2^+$, $(CH_3)_4N_2H^+$, $(CH_3)_5N_2^+$, etc. Ammonium dinitramide (ADN) is a currently preferred oxidizer according to the present invention.

Energetic binders which are used in the propellant formulations of the present invention include substituted oxetane polymers, nitramine polymers, polyethers, and polycaprolactones (any of which may be either plasticized or unplasticized). More specific energetic binders include PGN (poly-(glycidyl nitrate)), poly-NMMO (poly(nitratomethyl-methyl-oxetane)), GAP (glycidyl azide polymer), 9DT-NIDA (diethylene-glycoltriethyleneglycolnitraminodiacetic acid terpolymer), poly-BAMO (poly(bisazidomethyloxetane)), poly-AMMO (poly-(azidomethyl-methyloxetane)), poly-NAMMO (poly(nitramino-methyl-methyloxetane)), copoly-BAMO/NMMO, copoly-BAMO/AMMO, NC (nitrocellulose), and mixtures thereof.

Reactive metals, such as aluminum, magnesium, aluminum-magnesium alloys, and boron, are also preferably included in the propellant formulations of the present invention.

A typical solid propellant formulation within the scope of the present invention has the following ingredients:

| Ingredient | Weight % |
|---|---|
| Energetic binder | 10–35 |
| Reactive metal | 2–25 |
| Dinitramide salt | 50–70 |
| Curatives/stabilizers | 2–5 |

The lower range of reactive metal (about 2 to 5%) includes "reduced smoke" formulations, while the upper limit (25%) covers typical composite propellant formulations. Solids loadings in the range from about 65% to 90% are typical.

The following examples are offered to further illustrate the present invention. These examples are intended to be purely exemplary and should not be viewed as a limitation on any claimed embodiment.

EXAMPLE 1

A composite propellant formulation having 72% solids was prepared having the following ingredients:

| Ingredient | Weight % |
|---|---|
| PGN | 24.4 |
| Al (30 μm) | 13 |
| ADN | 59 |
| Curatives/Stabilizers | 3.6 |

The curatives and stabilizers included 0.4% MNA (N-methyl-p-nitroaniline), 3.11% Desmodur® N-100, a polyisocyanate curative obtained from Mobay, 0 05% acid scavenger (N,N,N',N'-tetramethyl- 1,8-naphthalenediamine, obtained from Aldrich), and 0.005% TPB (triphenyl bismuth).

The PGN (poly(glycidyl nitrate)), MNA, and acid scavenger were added to a warm mixer bowl (120° F.) and mixed at slow speed for 10 minutes. The aluminum was added and mixed at slow speed for 5 minutes. The ADN was added in one third increments over 30 minutes. All ingredients were then mixed for an additional 10 minutes under vacuum. Finally, the isocyanate curative and TPB were added and mixed at low speed for 10 minutes under vacuum. The propellant was cast and cured at 120° F. for 6 days.

The composite propellant had a burn rate at 1000 psi of 0.76 ips. By way of comparison, the burn rate of similar propellant formulations containing AN as the oxidizer have burn rates of about 0.2 ips at 1000 psi. The composite propellant had a pressure exponent from 500 to 1800 psi of 0.67 with a slope break observed near 2000 psi. Optical bomb tests show desirable ease of ignition and efficient aluminum combustion characteristics, comparable to AP and much better than other nonchlorine oxidizers such as AN. The predicted performance of the ADN formulation is significantly better than either the AN or AP oxidized analogous formulations.

Safety tests of this composite propellant indicate no ESD (electrostatic discharge) sensitivity due to the polar binder. Impact sensitivity was typical of a Class 1.3 composite (nondetonable) propellant, while friction sensitivity was slightly greater than a typical Class 1.3 composite propellant.

EXAMPLE 2

A composite propellant formulation having 72% solids is prepared according to Example 1, except that 5% aluminum and 67% ADN, by weight are included. It is expected that this propellant formulation has a slightly slower burn rate with cooler flame temperature than the propellant of Example 1. Significantly, the energy of this reduced smoke propellant is similar to metallized (16% Al) composite/AP propellant formulations.

EXAMPLE 3

A composite propellant formulation having 72% solids is prepared according to Example 1, except that 18% aluminum and 54% ADN, by weight are included. It is expected that this propellant formulation has additional performance enhancement with a possibly reduced pressure exponent than the propellant of Example 1.

EXAMPLE 4

A composite propellant formulation having 72% solids is prepared according to Example 1, except that 14.75% ammonium perchlorate (200 μm), by weight, replaces a like amount of the ammonium dinitramide. It is expected that this propellant formulation would contain about 4.5% HCl in its exhaust which is a significant reduction over standard AP propellant formulations. Processing may be improved, compared to the propellant formulation of Example 1. The presence of AP in the formulation adds another variable for ballistic control.

EXAMPLE 5

A composite propellant formulation having 72% solids is prepared according to Example 1, except that 20.0% ammonium nitrate (200 μm), by weight, replaces a like amount of the ammonium dinitramide. It is expected that this nonchlorine propellant formulation may have a reduced burn rate, compared to the propellant formulation of Example 1. However, it is also expected that this formulation will have lower cost and likely reduced hazards sensitivity, while maintaining very good performance.

Theoretical performance calculations were performed on the propellant compositions of Examples 1–5 which are summarized below in Table 1:

TABLE 1

| Ingredient | Ex. 1 | Ex. 2 | Ex. 3 | Ex.4 | Ex. 5 |
|---|---|---|---|---|---|
| Al | 13.00 | 5.00 | 18.00 | 13.00 | 13.00 |
| AP | -0- | -0- | -0- | 14.75 | -0- |
| AN | -0- | -0- | -0- | -0- | 20.00 |
| ADN | 59.00 | 67.00 | 54.00 | 44.25 | 39.00 |
| Binder/curative | 28.00 | 28.00 | 28.00 | 28.00 | 28.00 |
| Property | | | | | |
| Density lb/in$^3$ | 0.0628 | 0.0612 | 0.0638 | 0.0635 | 0.0622 |
| ΔIsp, sec† | +8.24 | +4.17 | +9.15 | +5.70 | +3.06 |
| ΔIsp · Density | +0.14 | −0.58 | +0.50 | +0.19 | -0.35 |
| Flame Temp., °C. | 3263 | 2997 | 3410 | 3272 | 3100 |
| % HCl, Exhaust | -0- | -0- | -0- | 4.49 | -0- |

†As compared to a production composite AP propellant formulation (16% Al).

From the data depicted in Table 1, it can be appreciated that ADN may either fully or partially replace AP as an oxidizer in propellant formulations without greatly sacrificing propellant performance, even at reduced metal loadings (13% Al versus the 16% Al comparison propellant). There is some reduction in propellant density, but a significant increase in Isp offsets this reduction. Importantly, the quantity of HCl in the propellant exhaust products can be eliminated or substantially reduced. In the reduced smoke formulation, Example 2, 5% Al expectedly gives lower performance than the highly metallized formulations, but the energy for this class of propellants is very good.

EXAMPLE 6

A composite propellant formulation having 72% solids is prepared according to Example 1, except that ammoniumtetrazole (ATDN) replaces the ammonium dinitramide. It is expected that this nonchlorine propellant formulation may have slightly reduced energy, compared to the propellant formulation of Example 1. However, it is also expected that this formulation will have a lower flame temperature, while maintaining very good performance.

EXAMPLE 7

A composite propellant formulation having 72% solids is prepared according to Example 1, except that aminoammoniumfurazan (DAFDN) replaces the ammonium dinitramide. It is expected that this nonchlorine propellant formulation may have slightly reduced energy, compared to the propellant formulation of Example 1. However, it is also expected that this formulation will have a lower flame temperature, while maintaining very good performance.

Theoretical performance calculations in which the oxidizer dinitramide counter ion is ammoniumtetrazole (ATDN) or the aminoammoniumfurazan (DAFDN) (Examples 6 and 7) are shown below in Table 2:

TABLE 2

| Ingredient | Ex. 6 | Ex. 7 |
|---|---|---|
| Al | 13.00 | 13.00 |
| ATDN | 59.00 | -0- |
| DAFDN | -0- | 59.00 |
| Binder/curative | 28.00 | 28.00 |
| Property | | |
| Density lb/in$^3$ | 0.0626 | 0.0624 |
| ΔIsp, sec† | −2.01 | −0.01 |
| ΔIsp · Density | −0.56 | −0.49 |
| Flame Temp., °C. | 3017 | 2972 |
| % HCl, Exhaust | -0- | -0- |

†As compared to a production composite AP propellant formulation (16% Al).

While slightly lower in energy than the analogous ADN formulation (Example 1 of Table 1), the formulations depicted in Table 2 could be useful in systems requiring a cooler flame temperature or a lower oxygen/fuel ratio for exhaust species modification. Because these ATDN and DAFDN oxidizers have a lower oxygen content, they would also be useful in reduced smoke (2–5% metal) formulations.

From the foregoing it will be appreciated that the present invention provides propellant formulations exhibiting efficient aluminum combustion and high propellant burn rates, while producing reduced or no chlorine-containing exhaust products.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A composite propellant formulation which does not contain chlorine comprising:

poly(glycidyl nitrate) binder having a concentration in the propellant formulation in the range from about 10% to about 35% by weight;

a dinitramide salt oxidizer in the range from about 50% to about 70% by weight;

a reactive metal selected from aluminum, magnesium aluminum-magnesium alloys, and boron, said reactive metal having a concentration in the propellant formulation in the range from about 2% to about 25% by weight; and a polyfunctional curative.

2. A composite propellant formulation as defined in claim 1, wherein the dinitramide salt oxidizer is ammonium dinitramide (ADN).

3. A composite propellant formulation as defined in claim 1, wherein the dinitramide salt oxidizer is tetrazolium dinitramide.

4. A composite propellant formulation as defined in claim 1, wherein the dinitramide salt oxidizer is ammoniumtetrazole dinitramide.

5. A composite propellant formulation as defined in claim 1, wherein the dinitramide salt oxidizer is aminoammoniumfurazan dinitramide.

6. A composite propellant formulation as defined in claim 1, wherein the energetic binder is poly(glycidyl nitrate), the dinitramide salt oxidizer is ammonium dinitramide (ADN), and the reactive metal is aluminum.

7. A composite propellant formulation as defined in claim 1, wherein the reactive metal has a concentration in the propellant formulation in the range from about 2% to about 5% by weight.

8. A composite propellant formulation which does not contain chlorine comprising:

a poly(glycidyl nitrate) binder having a concentration in the propellant formulation in the range from about 10% to about 35% by weight;

ammonium dinitramide oxidizer in the range from about 50% to about 70% by weight;

a reactive metal selected from aluminum, magnesium aluminum-magnesium alloys, and boron, said reactive metal having a concentration in the propellant formulation in the range from about 2% to about 25% by weight; and a polyfunctional curative, wherein the composite propellant formulation has an uncatalyzed burn rate of at least 0.76 ips at 1000 psi.

9. A composite propellant formulation as defined in claim 8, further comprising from about 0% to about 20% by weight ammonium nitrate, wherein the combined amount of ammonium nitrate and the dinitramide salt oxidizer in the composite propellant formulation does not exceed about 70% by weight.

* * * * *